United States Patent [19]

Lundblad

[11] 4,020,972

[45] May 3, 1977

[54] BANKNOTE DISPENSING MACHINE

[75] Inventor: Leif Lundblad, Huddinge, Sweden

[73] Assignee: Inter Innovation A.B., Stockholm, Sweden

[22] Filed: Aug. 21, 1975

[21] Appl. No.: 606,356

[30] Foreign Application Priority Data

Aug. 29, 1974 Sweden ..... 7410941

[52] U.S. Cl. ..... 221/13; 93/93 C; 194/DIG. 26; 221/21; 271/35; 271/245

[51] Int. Cl.[2] ..... B65H 3/04; B65H 29/58

[58] Field of Search ..... 221/12, 13, 9, 102, 221/21; 194/4, DIG. 26, DIG. 15; 93/93 C; 271/35, 213, 245, 246

[56] References Cited

UNITED STATES PATENTS

| | | | |
|---|---|---|---|
| 931,260 | 8/1909 | Boulard | 221/102 X |
| 3,760,158 | 9/1973 | Whitehead et al. | 194/DIG. 26 |
| 3,767,080 | 10/1973 | Erickson | 221/13 |
| 3,785,256 | 1/1974 | Nikkel | 93/93 C |
| 3,849,968 | 11/1974 | Kazumatateisi | 221/13 X |

*Primary Examiner*—Robert B. Reeves
*Assistant Examiner*—Francis J. Bartuska
*Attorney, Agent, or Firm*—Diller, Brown, Ramik & Wight

[57] ABSTRACT

This disclosure relates to a machine for dispensing a predetermined number of banknotes in bundle form with the banknotes being removed from a stack in sequence and there being counting apparatus for counting banknotes passing along a flow-path and a double note detector for detecting the simultaneous passage of plural banknotes along the same flow-path. The banknotes, as they are dispensed, are collected in a collecting compartment and if the proper number is dispensed without double notes being detected, the collected banknotes are delivered to a customer. However, if double banknotes are detected or there is an error in counting, the dispensing of notes from the stack ceases and all notes in the collecting department are diverted into a storage compartment and the machine is recycled.

10 Claims, 4 Drawing Figures

BANKNOTE DISPENSING MACHINE

This invention relates to banknote dispensing apparatus of the type adapted to deliver a desired number of banknotes from an internal storage means to an exit aperture.

The apparatus may be installed within a bank thereby to provide a facility for the rapid withdrawal of sums of money without the need for a cashier. Alternatively, it may be installed in the outer wall of a bank, in a shopping precinct or an airport, for example, to provide a 24-hour per day facility for obtaining money.

It follows that the reliability of such an apparatus is of extreme importance particularly when the dispenser is not supervised in any direct manner. For example, considerable inconvenience may be caused to customers if the apparatus fails to operate upon the presentation of a withdrawal card through malfunctioning of the apparatus.

It is also necessary to ensure that only the correct quantity of banknotes are delivered to the customer. For example, it is possible for a feeding mechanism to inadvertently feed two adhered together banknotes as a single banknote. As a safeguard against this eventuality a "fail-safe" device may be incorporated to shut down the apparatus upon the detection of such a misfeed but such a solution causes inconvenience.

Most cases of failure of such apparatus have been found to involve the efficiency of the feeding mechanisn which in turn is mainly dependent upon the condition of the banknotes it is required to handle. The banknotes may have been previously subjected to an indeterminate degree of wear and/or misuse and accordingly, occasions may arise wherein a pair of juxtaposed banknotes contained in a stack within the apparatus are so adhered or locked together through damaged edges that the feeding mechanism is unable to separate them and feed them as single banknotes.

It is the prime object of the present invention to overcome the above difficulty by providing a means which does not prevent misfeeding from taking place but does prevent an incorrect quantity of banknotes from reaching the customer.

According to this invention a machine for dispensing a desired number of banknotes comprises means for supporting a stack of banknotes, primary feeding means for feeding banknotes sequentially from said stack along a first flowpath, a collecting compartment inaccessible to a user of the machine and situated at the end of the first flowpath for collecting banknotes in the form of a bundle, means for transporting a bundle of banknotes along a second flowpath between the collecting compartment and an aperture accessible to said user, divertor means disposed in the second flowpath and adapted to divert from said flowpath a bundle which does not contain the desired number of banknotes.

The primary feeding means may be sheet feeding means of any kind provided that it is so constructed and designed as to work to a high degree of reliability in the feeding of single banknotes from the stack. Clearly, any machine in accordance with this invention must be capable of operation with a very low number of occasions upon which faulty feeding occurs.

Preferably the machine also includes means for detecting the passage of wholly or partially overlapped banknotes to the collecting compartment. Such banknotes, not being banknotes fed sequentially will result in an incorrect number of banknotes arriving in the compartment and hence, subsequent to such detection, the divertor means diverts the incorrect bundle.

The collecting compartment conveniently comprises a pair of driven belts which, in one position, are arranged with a space between them for the entry of banknotes and in a second position move relatively towards each other to engage and feed a bundle from the compartment. However, equivalent means may be employed.

The compartment preferably includes a stop which serves as a register surface for the leading edges of banknotes fed thereto, the stop being movable to permit the transportation of a bundle from the compartment.

In order to produce a machine of compact dimensions we prefer to turn the banknotes through 180° during their passage from the stack to the collecting compartment.

Bundles diverted from the second flowpath are conveniently directed to a third flowpath which terminates in a receptacle for incorrect bundles. Such a receptacle may be integral with a removable cassette which also includes the stack of banknotes.

An example of the invention will now be described with reference to the accompanying drawings of which FIG. 1 is a perspective view of the front of an automatic banknote dispenser intended for use on a desk or table;

Figure 1:
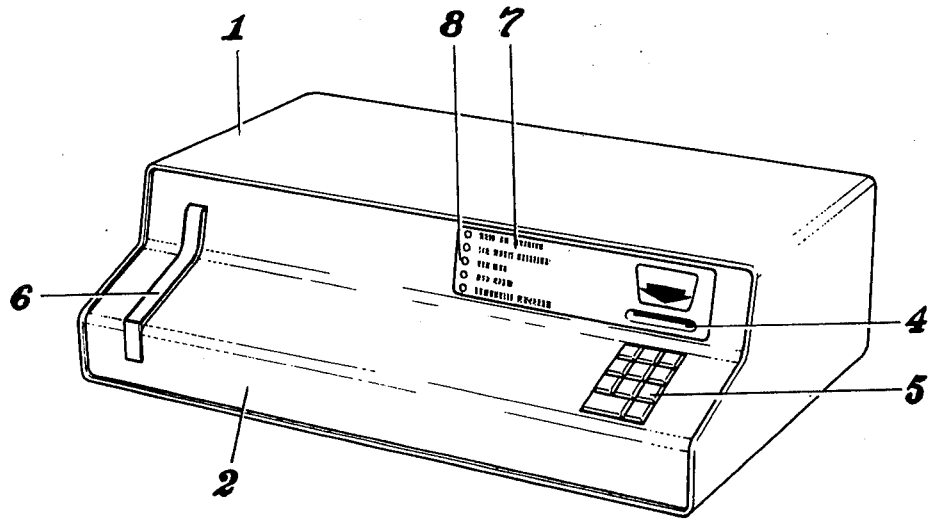

It should be noted that in the drawings and the following description, frame members and other structural supporting components, shaft bearings and driving means, have been omitted for reasons of simplicity. The exact configuration of these items is not critical to the invention and accordingly they may be of any suitable form to provide the desired function.

Figure 2:
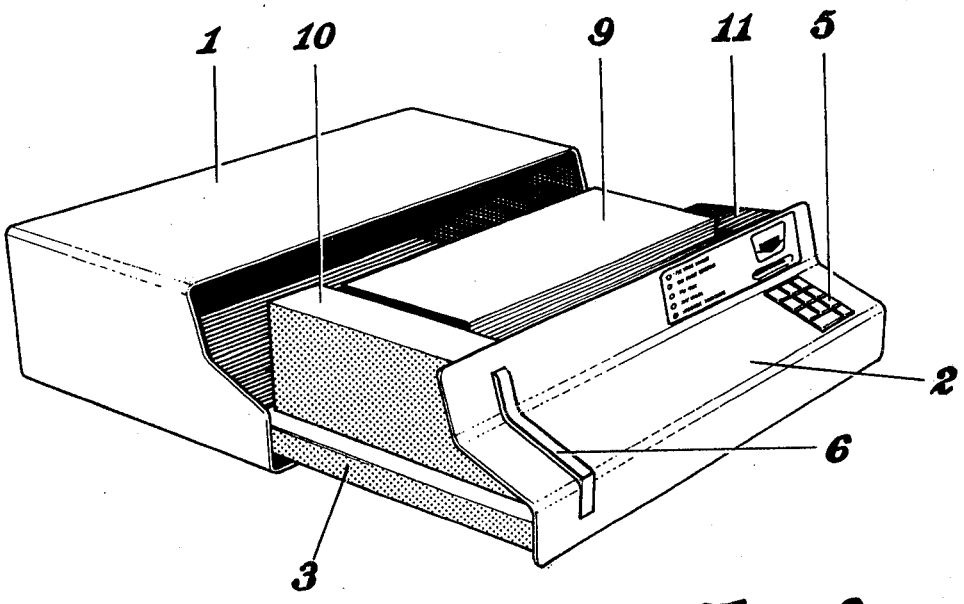
FIG. 2 is a front perspective view of the dispenser from a different viewing angle showing the frontal portion and the interior thereof withdrawn from its casing.

The dispenser comprises an external box-like casing 1, which terminates at a curved frontal facia control panel 2. To permit the replenishment and and removal of banknotes stored within the dispenser, and also to obtain access to the mechanism for servicing, the frontal panel 2 together with the entire internal mechanism is adapted to slide forward on a suitable base-place and guide rails, generally indicated by symbol 3 (see FIG. 2).

The frontal panel 2 essentially includes a horizontal slot 4 for the insertion of a customer's money-withdrawal card and its return after scrutiny inside the apparatus, a keyboard 5 to enable a customer to enter a personal identification code together with details of a sum of money required, and an output slot aperture 6 into which a bundle of banknotes are delivered by the dispensing mechanism for subsequent removal by the customer. In addition, the frontal panel is provided with a printed legend 7 to inform the customer of the correct operation of the apparatus and a number of indicator lights 8 to monitor the sequence of the various operations as they are effected.

The internal mechanism of the apparatus is described in detail below, but briefly it comprises a removable cassette 9 which contains a supply magazine capable of accommodating 2000 banknotes and also an auxiliary compartment for the receipt of banknotes rejected by the dispenser, a dispensing mechanism diagrammatically indicated by symbol 10, and a control module 11. Suitable security locking means, not shown, are provided to prevent access to the interior of the apparatus when it is in use.

Figure 3:
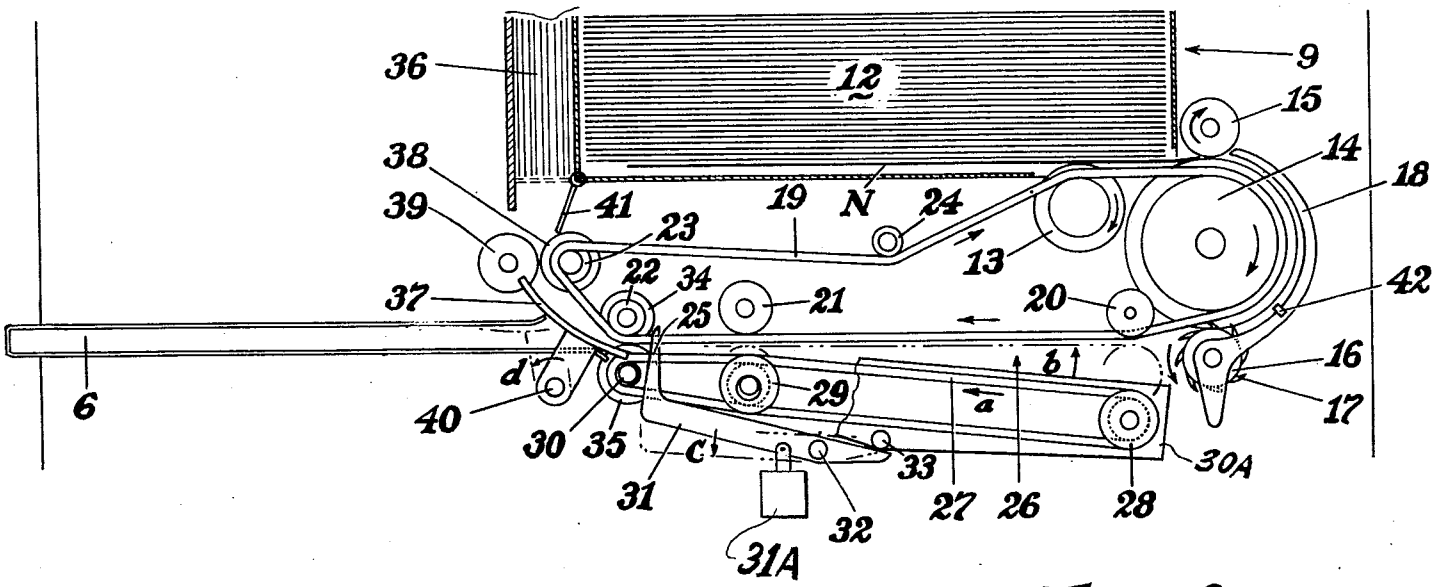
FIG. 3 is a reversed diagrammatic plan view of the main mechanical components of the dispensing mechanism.
Figure 4:
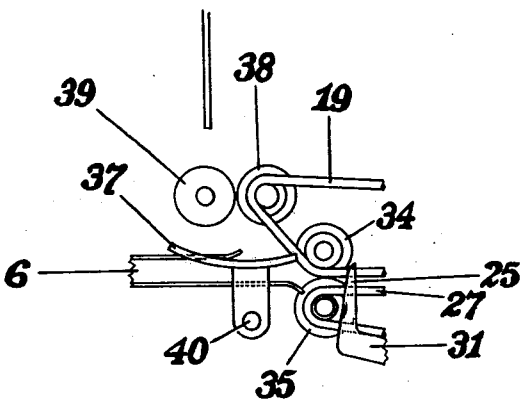
FIG. 4 is a fragmentary drawing of FIG. 3 but showing some of the components in a different operative position.

Referring now to FIGS. 3 and 4, the cassette 9 containing a stack of banknotes 12 disposed on edge is shown in position adjacent the dispensing mechanism which comprises a primary friction feed roller 13 adapted to engage the front face of the stack via an opening formed in a side wall and corner of the cassette as shown. Spring means are provided within the cassette to bias and feed the stack against the said side wall. The feed roller 13 is driven in a clockwise direction thereby to engage frictionally the front banknote N and propel it across the face of the remainder of the stack to the frictional periphery of a secondary feed roller 14. Adjacent the roller 14 there is provided a stripping roller 15 having a periphery driven in a direction opposite to that of the secondary feed roller 14, thereby to hold-back a superposed banknote which under certain circumstances may have been fed simultaneously from the magazine.

The feeding means also includes a means for creating relative separation between the primary feed roller 13 and the underside of the banknotes in the magazine to provide a STOP/START control facility. Such a means is well known in the art of sheet feeding apparatus and may, for example, comprise a solenoid-operated lifting device capable of moving the stack away from the feed roller when in an energised condition.

The banknote N is fed around 180° of the periphery of the roller 14 and is thereafter engaged by means of a freely running nip roller 16 having fixedly mounted thereto a ratchet wheel 17. An arcuate guide plate 18 is provided to guide the leading edge of the banknote around the roller 14 and into the nip formed by the roller 16.

The primary and secondary feed rollers 13 and 14 are driven in unison by means of a belt 19 which is supported by guide pulleys 20, 21, 22, 23 and 24 and also forms the propulsion means for the subsequent transportation of an assembly of banknotes in the manner described below.

Banknotes conveyed through the nip of the rollers 14 and 16 are fed against a stop member 25 which forms the front end component of a collecting compartment 26. The nip roller 16 and the ratchet wheel 17 collectively define the rear end of the collecting compartment and the longitudinal sides thereof are defined by the belt 19 and a further belt 27 disposed in spaced relationship thereto.

It is so arranged that the length of the collecting compartment 25 (viz the distance between the components 25 and 16; 17) is slightly less than the length of a banknote. Accordingly, when the leading end of a banknote contacts the stop member 25 the trailing end of the same is engaged between a pair of adjacent teeth of the ratchet wheel 17 and is deflected tangentially in a direction away from the flowpath of the banknote thereby to provide a clear entrance for the following banknote.

The belt 27 is driven in the direction of the arrow *a* and is carried upon three guide pulleys 28, 29 and 30, the axes of which are mounted upon a pivotal lever assembly 30A. The said lever assembly is pivoted about a vertical axis disposed in the vicinity of the pulley 30 and is spring-biased to a normal inoperative position, as shown in FIG. 3. The lever assembly is adapted for anti-clockwise rotation against the biasing spring (see arrow *b*), thereby to move the belt 27 towards the belt 19 and to engage the opposite sides of a bundle made up from banknotes which have been previously fed into the collecting compartment 26.

The stop member 25, which forms the end of the collecting compartment, is integrally mounted to an end of a lever 31 pivoted to the structure of the apparatus by means of a vertical shaft 32. The opposite end of the lever 31 is adapted to co-operate with a spigot 33 which is attached to the above mentioned lever assembly. The normal rest position for the lever 31 is illustrated in FIG. 3 from which it will be apparent that anti-clockwise rotation of the same (see arrow *c*) from this position will, (i) retract the stop member 25 from between the belts 19 and 27, and (ii) move the belt 27 towards the belt 19 (via the interconnection between the lever 31 and the spigot 33). Anti-clockwise rotation of the lever 31 is effected by means of a solenoid 31A which is energised by the control module in the manner described below.

Fast with the belt guide pulleys 22 and 30 are provided a co-operating pair of rubber traction rollers 34 and 35, respectively, which serve to grip and propel a bundle of banknotes from the collecting compartment 26 when the stop member 25 is retracted. Thereafter the said bundle is routed to either of two possible destinations, viz to the output slot aperture 6, or to the above referred auxiliary compartment in the cassette indicated by symbol 36, by means of a pivotally mounted divertor 37 and a further pair of rubber traction rollers 38 and 39. It will be seen that the roller 38 is driven from the guide pulley 23 which is in turn driven by the belt 19.

The divertor 37 is mounted upon an axis 40 and is spring-biased to the position shown in FIG. 3. The divertor is adapted for movement in an anti-clockwise direction (see arrow *d*) by means of a solenoid (not shown) which is energised by the control module in the manner described below (see FIG. 4), thereby to route a bundle of banknotes to the output slot aperture 6.

The entrance of the auxiliary comparment 36 of the cassette is provided with a hinged door 41, which is opened automatically when the cassette is inserted into the apparatus.

It should be noted that whilst the various rollers, belts, guides etc. have been referred to in the singular, these are generally of plural quantities spatially disposed in side-by-side manner thereby to engage the sheets or bundles of sheets along a plurality of parallel zones. For example, each of the belts 19 and 27 comprises a plurality of separate belts of circular cross-section disposed in parallel relationship and carried on an equivalent number of guide pulleys axially spaced on common axes.

Banknotes fed from the magazine 12 are sensed by means of a conventional photoelectric detection device 42 disposed in the vicinity of the arcuate guide member 18. The detection device is adapted to count the passage of single banknotes and also to detect the simultaneous passage of plural banknotes.

A further detection device (not shown) is disposed adjacent to, and downstream of the stop member 25, to detect the passage of a bundle of banknotes and thereafter to initiate the return of the stop member 25 to its normal operative position (i.e. as shown in FIG. 3) to enable a further bundle to be formed in the collecting compartment 26. It thus follows that in the event of a failure of the divertor operating solenoid all bundles of banknotes will be diverted to the compartment 36.

OPERATION OF THE APPARATUS

Money is withdrawn from the dispenser by means of the customer placing his withdrawal card in the slot 4. The card is then fed automatically to a card scrutiniser and information derived therefrom is transmitted to a computer for checking. If the card is approved one of the indicator lights 8 is illuminated requesting details of the sum of money required to be entered into the control module by means of the keyboard 5. Thereafter, a further indicator light requests the customer to enter his individual personal code. If this code agrees with the number contained on the card, the card is returned to the slot 4, and the apparatus proceeds to dispense the required quantity of banknotes and to debit the customer's account.

In the following practical example of a dispenser adapted to dispense 100 KRONOR banknotes it is assumed that a customer requests the delivery of banknotes totalling 700 KRONOR. Depression of the numeral "7" on the keyboard transmits impulses via the control module to the dispenser for the dispensation of seven banknotes from the magazine to the collecting compartment 26. The drive means for the dispenser is activated to feed banknotes from the stack and the photoelectric detection device 42 senses the passage of the notes and via the control module ensures that a further note is removed from the magazine only when the previous note has travelled a predetermined distance towards the compartment 26. In addition the detection device 42 checks that only single banknotes are fed into the compartment and also actuates an electronic counter in the control module upon the passage of each banknote. Upon the attainment of the correct count corresponding to the sum of money requested, the control module, (i) arrests operation of the feed means, (ii) energises the divertor-operating-solenoid to move the divertor to the position shown in FIG. 4, and (iii) energises the stop-member-actuating solenoid. The latter operation retracts the stop member 25 from the end of the collecting compartment 26 and moves the belt 27 to engage the bundle of seven banknotes. Thereafter, the belts 19 and 27 collectively propel the bundle to the end of the output aperture 6 where they are removed by the customer. When the bundle passes beyond the above mentioned further detection device the stop member 25 returns to its operative position to enable a further dispense cycle to be effected.

If however, the feeding mechanism inadvertently delivers a pair of superposed banknotes at any time during the dispensation, a signal indicative of this occurrence will be transmitted to the control module from the detection device 42 and the following sequence of operation will prevail: (i) the feeding means will be arrested, (ii) the stop-member-actuating solenoid will be energised and accordingly the bundle so far collected will be propelled into the auxiliary collecting compartment 36 via the divertor 37 and the traction rollers 38 and 39, and (iii) the counter in the control module will be re-set to zero and the feeding means will then re-commence operation to feed seven banknotes into the collecting compartment 26.

In an alternative embodiment of the invention the control module may be programmed to cause the feeding means to complete the intended full delivery of banknotes to the collecting compartment in spite of the detection of the simultaneous passage of plural banknotes. This alternative is, however, inherently wasteful as far as rejected banknotes are concerned but simplifies the operating precedure by permitting a standard feeding cycle to be used regardless of the passage of plural banknotes.

If, for any reason other than the feeding of superposed banknotes, the correct count is not obtained at the end of a feeding cycle a signal indicative of this failure will result in (i) the energisation of the stop-member-actuating solenoid and the propulsion of the incorrect bundle into the auxiliary collecting compartment 36, via the divertor 37 and the traction rollers 38 and 39, and (ii) the re-setting to zero of the counter and the commencement of a fresh operation to feed the desired seven banknotes.

To prevent a customer from forgetting to remove his withdrawal card from the slot 4, a safety means may optionally be provided. For example, a card-sensing device may be provided internally of the slot 4 and adapted so as to inhibit the delivery of the bundle from the collecting compartment until the card is removed from the apparatus.

To facilitate operatin of the apparatus various warning or safety devices may be incorporated in the dispenser, for example, a warning signal may be created by a suitable detector means in the cassette when the contents of the magazine contained therein is depleted beyond a predetermined quantity of banknotes, and also a similar signal may be created when the auxiliary compartment of the cassette exceeds a predetermined quantity of rejected banknotes. Furthermore, a means may be provided to actuate a warning automatically if the removable assembly of the dispenser is not securely locked within its casing or if someone in an illegal manner tries to gain access to the interior of the apparatus.

The control module and its associated circuitry and components may take various forms provided that they are capable of performing the functions and sequences of operation above described. The foregoing description is sufficiently detailed for a skilled person to select suitable components and circuitry from the wide range of commercially available card readers information storage registers, optical detectors, counters, timing devices etc.

It will thus be appreciated that by means of the described invention the ability of a banknote dispenser to deliver a correct desired number of banknotes to a customer is not dependent upon the ability of the feeding mechanism to feed the banknotes singly from a storage stack, and consequently the condition of the banknotes does not materially effect the output of the dispenser.

I claim:

1. A machine for dispensing bundles of banknotes comprising means for supporting a stack of banknotes; a banknote removing means for removing banknotes sequentially from said stack; a first conveyor means for conveying removed banknotes in serial spaced relationship along a first flow-path; detector means for detecting the simultaneous passage of plural banknotes along said first flow-path; a collecting compartment for collecting banknotes in the form of a bundle, said collecting compartment being inaccessible to a user of the machine, said collecting compartment at least in part being formed by said first conveyor means and including stop means normally disposed to inhibit movement of the banknotes by said first conveyor means beyond said collecting compartment but retractable to permit further movement of a bundle of banknotes by said first conveyor means, a second flow-path for receiving a bundle of banknotes from said collecting compartment, said second flow-path terminating in a delivery aperture accessible to said user; and divertor means under the control of said detector means for diverting from said second flow-path a bundle of banknotes which includes banknotes detected as plural banknotes by said detector means, said collecting compartment being further formed by additional conveyor means, disposed in spaced relationship to said first conveyor means, and the space between the additional conveyor means and said first conveyor means accommodating a bundle of banknotes.

2. A machine as claimed in claim 1 in which said additional conveyor means is mounted for movement from a remote first position towards a second position adjacent said first conveyor means thereby to cause the faces of remote banknotes of a bundle of banknotes to be engaged by said first and additional conveyor means, and there are powered means for effecting said movement of said additional conveyor means and movement of said stop means to its retracted position.

3. A machine as claimed in claim 2 including pivotal lever means for mounting said additional conveyor means and in which said powered means comprises a solenoid.

4. A machine as claimed in claim 1, in which said stop means is mounted on a pivotal lever means and there are solenoid means for pivoting said lever to retract said stop means to permit the movement of a bundle of banknotes along said second flow-path.

5. A machine as claimed in claim 1 in which both said first conveyor means and said additional conveyor means comprise endless belts.

6. A machine as claimed in claim 1 including means for deflecting the trailing end of a banknote away from said first conveyor means subsequent to the complete entry of a banknote into the collecting compartment, thereby to facilitate the entry of a next following banknote into sad collecting compartment.

7. A machine as claimed in claim 6 in which the means for deflecting the trailing end comprises a driven wheel having projections on its periphery and so positioned relative to said stop means that the distance between said wheel and said stop means is less than the length of a banknote.

8. A machine as claimed in claim 1 in which the divertor means comprises a pivotal plate biased to the position for diverting a bundle from the second flow-path but capable of being moved clear of the second flow-path.

9. A machine for dispensing a predetermined number of banknotes in bundle form comprising means for supporting a stack of banknotes, banknote removing means for removing banknotes sequentially from said stack; first conveyor means for conveying removed banknotes in serial spaced relationship along a first flow-path; counting means for counting banknotes passing along said first flow-path; a collecting compartment for collecting banknotes in the form of a bundle and inaccessible to a user of the machine, said collecting compartment at least in part being formed by said first conveyor means and including stop means normally disposed to inhibit movement of the banknotes by said first conveyor means beyond said compartment means but retractable to permit the movement of a bundle of banknotes by said first conveyor means; a second flow-path for receiving a bundle of banknotes moved by the first conveyor means from said collecting compartment and terminating in a delivery aperture accessible to a user of said machine; and divertor means under the control of said counting means for diverting from said second flow-path a bundle of banknotes which does not contain said predetermined number, said collecting compartment being further formed by additional conveyor means disposed in spaced relationship to said first conveyor means, and the space between the addditional conveyor means and said first conveyor means accommodating a bundle of banknotes.

10. A machine for dispensing a predetermined number of banknotes in bundle form comprising cassette means including a first section for supporting a stack of banknotes and a second section for receiving rejected bundles of banknotes; banknote removing means for removing banknotes sequentially from said stack; first conveyor means for conveying removed banknotes in serial spaced relationship along a first flow-path; detector means for detecting the simultaneous passage of plural banknotes along said first flow-path; counting means for counting banknotes passing along said first flow-path; a collecting compartment for collecting banknotes in the form of a bundle and being inaccessible to a user of said machine, said collecting compartment comprising at least a part of said first conveyor means and stop means normally disposed for inhibiting movement of the banknotes by the said first conveyor means but retractable to permit the further movement of a bndle of banknotes by said first conveyor means, a second flow-path for receiving a bundle of banknotes moved by the first conveyor means and terminating in a delivery aperture accessible to a user of said machine; and divertor means under the control of said detector means for diverting from said second flow-path and into said second section of said cassette a bundle of banknotes which includes selectively banknotes detected as plural banknotes by said detector and banknotes which do not include said predetermined number, said collecting compartment being further formed by additional conveyor means disposed in spaced relationship to said first conveyor means, and the space between the additional conveyor means and said first conveyor means accommodating a bundle of banknotes.

* * * * *